US006331192B1

(12) United States Patent
Jäkärä et al.

(10) Patent No.: US 6,331,192 B1
(45) Date of Patent: Dec. 18, 2001

(54) BLEACHING OF CHEMICAL PULP AND TREATMENT WITH A CHELATING AGENT

(75) Inventors: Jukka Jäkärä , Vaasa; Reijo Aksela, Espoo; Aarto Parén, Vaasa; Ilkka Renvall, Espoo, all of (FI)

(73) Assignee: Kemira Chemicals Oy, Helsinki (FI)

( * ) Notice: Subject to any disclaimer, the term of this patent is extended or adjusted under 35 U.S.C. 154(b) by 0 days.

(21) Appl. No.: 09/554,331

(22) PCT Filed: Nov. 13, 1998

(86) PCT No.: PCT/FI98/00887

§ 371 Date: Jun. 30, 2000

§ 102(e) Date: Jun. 30, 2000

(87) PCT Pub. No.: WO99/25919

PCT Pub. Date: May 27, 1999

(30) Foreign Application Priority Data

Nov. 13, 1997 (FI) ..... 974221

(51) Int. Cl.[7] ..... D06L 3/06; D06L 3/02
(52) U.S. Cl. ..... 8/109; 8/108.1; 8/111
(58) Field of Search ..... 8/108.1, 109, 111

(56) References Cited

FOREIGN PATENT DOCUMENTS

| | | |
|---|---|---|
| 0 740 015 A1 | 10/1996 | (EP) . |
| WO95/14808 | 1/1995 | (WO) . |
| WO95/27100 | 12/1995 | (WO) . |
| WO97/45586 | 4/1997 | (WO) . |

*Primary Examiner*—Yogendra N. Gupta
*Assistant Examiner*—John M Petruncio
(74) *Attorney, Agent, or Firm*—Greenberg Traurig, LLP

(57) ABSTRACT

The invention relates to a process for the bleaching of chemical pulp, wherein the pulp is delignified and/or bleached with chlorine dioxide or with a combination of chlorine dioxide and a per-compound, and additionally the pulp is chelated in order to bind heavy metals, such as Fe, Mn and/or Cu, to a chelate complex. The chelate complex is selected from the group made up of N-bis-[(1,2-dicarboxylethoxy)-ethyl]-amine, N-bis[(1,2-dicarboxylethoxy)-ethyl]-aspartic acid and N-tris-[(1,2-dicarboxylethoxy)-ethyl]-amine, and the alkali metal and earth-alkali metal salts of these, and the chelating treatments are carried out simultaneously by combining the chelating chemical with the pulp in the same bleaching stage as chlorine dioxide.

11 Claims, No Drawings

BLEACHING OF CHEMICAL PULP AND TREATMENT WITH A CHELATING AGENT

FIELD OF THE INVENTION

The invention relates to a process for the bleaching of chemical pulp with chlorine dioxide or with a combination of chlorine dioxide and a per-compound, and additionally the pulp is chelated in order to bind heavy metals, such as Fe, Mn and/or Cu, to a chelate complex.

The purpose of the bleaching of chemical pulp is to bring to completion after digestion the removal of the residual lignin from the pulp. The bleaching is nowadays often started with oxygen delignification, whereafter further bleaching can be carried out by various methods. In TCF bleaching the delignification can be continued with, for example, ozone, peracetic acid or hydrogen peroxide in acid or alkaline conditions. Chlorine dioxide stages are used in ECF bleaching, wherein the chlorine dioxide stages are separated by an alkali stage. In ECF bleaching, also, oxygen chemicals are being used increasingly often to promote the bleaching. For example, by the use of hydrogen peroxide in the ECF bleaching sequence it is possible to save chlorine dioxide. Also for environmental reasons the aim is to use ever smaller doses of chlorine dioxide in bleaching. Furthermore, processes have been developed wherein chlorine dioxide and peracetic acid are used in one and the same stage.

However, when oxygen, ozone, hydrogen peroxide and per-acids (so-called oxygen chemicals) are used, there is the problem of the heavy metals present in the pulp. The detrimental metals in pulping processes include primarily iron, manganese and copper. These heavy metals pass into the raw pulp along with wood, process waters or digestion chemicals, and they catalyze the breaking down of carbohydrates in the presence of oxygen chemicals and thereby substantially lower the quality of the pulp They are especially detrimental in hydrogen peroxide bleaching. In TCF-bleaching, the bleaching stage carried out oxygen chemicals are often preceded by the binding or removal of the heavy metals, since they have a detrimental effect in bleaching or delignification carried out using oxygen chemicals.

The chlorine dioxide doses used in conventional ECF bleaching are so high, and thus the pH of the bleaching stage is also so low, that the heavy metals dissolve and are washed out of the pulp. When lower chlorine dioxide doses are used, the pH of the chlorine dioxide stage may remain higher and the washing out of the metals is not so effective. The use of too low a pH in the chlorine dioxide stage may reduce the strength of the pulp and cause dissolving of carbohydrates, which is not desirable. It is also possible to remove the metals by a separate treatment, such as an acid wash, or in a chelation stage. In terms of the removal of the metals there is no difference between an acid wash and a chlorine dioxide stage, except that an acid wash does not delignify or bleach the pulp.

BACKGROUND OF THE INVENTION

A separate chelating stage is the most effective method for removing the heavy metals from pulp. However, it is also a mere pretreatment for oxygen chemical stages, and it does not delignify or bleach the pulp. Thus separate chelating stages or acid washes in ECF bleaching would be idle stages in terms of the process. In addition, it is to be taken into account that these stages would require a separate bleaching tower with washers, and thus investments would be required at the mill. Another option would be to take the resources required by this stage from the actual bleaching or delignifying stage. If this were done, the conditions should be made harsher in other stages, whereupon the strength of the pulp might suffer.

WO application publication 95/27100 describes a process for a complex treatment of pulp in connection with the chlorine dioxide stage. The complexing agents used are ethylene diamine tetra-acetic acid (EDTA) and diethylene triamine penta-acetic acid (DTPA). The poor biodegradability of the complexing agents can, however, be regarded as a problem.

SUMMARY OF THE INVENTION

However, it has now been observed, surprisingly, that instead of EDTA and DTPA it is preferable to use the new environment-friendly chelating agents developed by the present applicant. The use of chelating agents is not profitable in the chlorine dioxide stage or the bleaching stage in which a combination of chlorine dioxide and a per-acid is used, unless chelating agents compatible with the per-acid and/or chlorine dioxide are available. The Mn complexes of EDTA and DTPA are highly effective in breaking down per-acids, and therefore they are not suitable for this purpose. Also, DTPA does not withstand chlorine dioxide.

It is an object of the present invention to provide a process by which chelating which binds heavy metals can be combined with the chlorine dioxide bleaching of pulp, or with a combination of chlorine dioxide and a per-acid, in such a manner that the process will be simpler than previously. The process is based on the use of complexing agents developed by the applicant, and it is characterized in that the chelatins is carried out using a chemical selected from the group consisting of N-bis-[(1,2dicarboxylethoxy)-ethyl]-amine, N-bis-[(1,2-dicarboxylethoxy)-ethyl]-aspartic acid, N-tris-[(1,2-dicarboxylethoxy)-ethyl)]-amine, and the alkali metal and earth-alkali metal salts of these.

DETAILED DESCRIPTION OF THE INVENTION

The formulae of the tetradentate and hexadentate complexing agents (A B, C) used in the process as the chelating chemicals are:

A

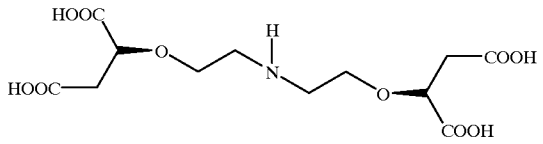

B

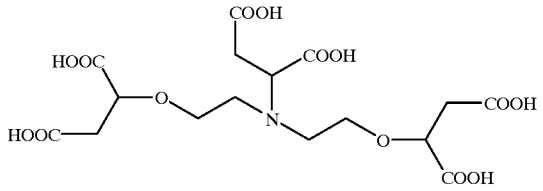

C

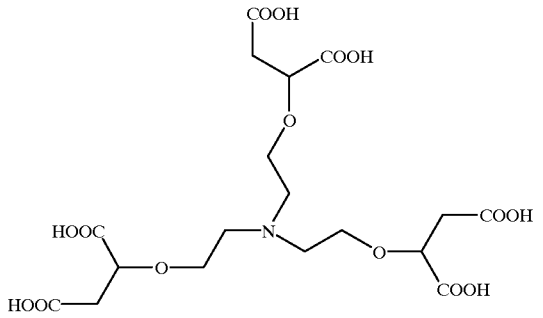

Hereinafter, the acronym BCEEA will be used for N-bis-[(1,2-dicarboxylethoxy)-ethyl]-amine (A), the acronym BCEEAA for N-bis-[(1,2dicarboxylethoxy)-ethyl]-aspartic acid (B), and the acronym TCEEA for N-tris-[(1,2-dicarboxylethoxy)-ethyl]-amine (C).

The process for preparing these chelating agents is described in FI patent application 962261. These compounds can be used as such in acid form or as their alkali metal or earth-alkali metal salts. Bach one of the chelating agents mentioned above can be used alone in a bleaching stage carried out using chlorine dioxide or a combination of chlorine dioxide and a per-compound. It is especially advantageous to use a mixture of compounds A and B, BCEEA+BCEEAA. In the mixture the molar ratio of the compounds is typically approx. 2:3 (A:B).

In the process according to the invention the per-compound is preferably peracetic acid (PAA).

A preferable chlorine dioxide dose is approx. 5–30 kg/metric ton, and a preferable per-compound dose is 2–10 kq/metric ton.

The chelating agents can be used together with chlorine dioxide and, for example a combination of chlorine dioxide and peracetic acid. In these stages the pH is typically on the acid side, with chlorine dioxide <4 (delignification) or 4–5 (bleaching) and with peracetic acid it is 5–7. With a combination of chlorine dioxide and a per-acid the optimum pH is approx. 5–6. This pH range is highly suitable for the above-mentioned chelating agents. It has additionally been observed that the BCEEA—BCEEAA mixture does not break down under the effect of these bleaching chemicals but, instead, is capable of even stabilizing peracetic acid in the conditions concerned. Furthermore, it has been observed that the said chelating agent mixture forms metal complexes in a more or less normal manner in spite of the presence of strongly oxidizing bleaching chemicals.

What has been gained by this procedure is that it is possible to enhance especially bleaching carried out using low chlorine dioxide doses, i.e. so-called ECF-Light bleaching, because owing to the improved metal control the consumption of chemicals is lowered or, respectively, a higher brightness is achieved or, for example, the yield can be increased by raising the digestion kappa number. Through the elimination of the need for a separate chelating stage it is possible either to make available more bleaching stages for enhancing delignification/bleaching or to avoid the investment in a bleaching tower and washers.

The use of the novel chelators provides the additional advantage that the process is environment-friendly. In addition to the novel chelating agents having better biodegradability, owing to the enhanced bleaching and the use of oxygen chemicals it is possible to use lower chlorine dioxide doses, whereupon the AOX emissions are lower and the closing of the water cycles is facilitated.

There are no limitations on the use of the process in a bleaching sequence consisting of a plurality of stages; it can be used on a pulp coming directly from digestion, on oxygen- or ozone-delignified pulp or on pulp after any stage. After the process it is possible to carry out bleaching by using, for example, an alkaline peroxide stage or a peroxide-reinforced oxygen-alkali stage.

The process is suitable for use on sulfate pulps and other chemical pulps prepared from softwood or hardwood or from various grasses.

The invention is illustrated in greater detail with the following examples. It should be pointed out that the mixture used in the examples of the chelating agents according to the applicant's invention, BCEEA+BCEEAA, contained 18% BCEEA and 34% BCEEAA, the balance being in the main water. It is also possible to use BCEEA, BCEEAA or TCEEA alone as a chelating agent. A wash in the normal manner was carried out between the stages described in the examples. The doses in the tables are indicated in kilograms per metric ton of pulp (kg/tp).

EXAMPLE 1

An oxygen delignified birch pulp was delignified first with chlorine dioxide (D or Q/D in Table 1), this was followed by an oxygen-alkali stage reinforced with peroxide (EOP) and a final bleaching with chlorine dioxide and/or a combination of chlorine dioxide and peracetic acid (D or D/PAA). The reference experiment was a D-Eo-D bleaching with an active chlorine dose of 40 kg/tp (total dose). The table shows that the bleaching can be carried out with a D-EOP-D sequence with an active chlorine dose of 25 kg/tp or with an $H_2O_2$ dose of 10 kg/tp to the same degree of brightness as with D-Eo-D with an active Cl dose of 40 kg/tp. However, the kappa number remains higher, which may cause after-yellowing. It is seen that, when the chelating agent is used in the first chlorine dioxide stage, the DTPA does somewhat lower the heady metal concentrations, but it is not otherwise useful in terms of the bleaching. In the last bleaching stage with the D/PAA combination, DTPA is even detrimental. On the other hand, when a mixture of BCEEA and BCEEAA is used as a chelating agent in the chlorine dioxide stage, it is observed that the manganese contents are lowest and the brightness in the EOP stage is highest. Likewise, the consumption of peroxide in EOP is lowest. Furthermore, in the D/PAA stage the addition of BCEEA+BCEEAA clearly improves the brightness. The table also shows a favorable effect of the BCEEA+BCEEAA addition on the viscosity of the pulp. The test series is shown in Table 1.

TABLE 1

ECF bleaching experiments on birch sulfate pulp

| Initial situation | Oxygen-beignified birch pulp | | | |
|---|---|---|---|---|
| Kappa number | 11.5 | Fe | 14.3 | mg/kg |
| Viscosity, dm3/kg | 90.1 | Mn | 37.4 | mg/kg |
| Brightness, % ISO | 56.6 | | | |

| | D | D | Q/D | Q/D |
|---|---|---|---|---|
| t, min | 120 | 120 | 120 | 120 |
| T, C | 70 | 70 | 70 | 70 |
| Cs, % | 10 | 10 | 10 | 10 |
| pH | 3.8 | 4.5 | 4.5 | 4.5 |
| ClO2, kg/tp | 30 | 15 | 15 | 15 |
| Chelator | None | None | DTPA | BCEEA+ BCEEAA |
| Dose, kg/tp | - | - | 2 | 2 |
| Mn, ppm | 12.8 | 31.2 | 18 | 11 |
| Fe, ppm | 6.0 | 9.1 | 4.5 | 7.0 |
| Ca, ppm | 190 | 252 | 233 | 224 |
| Mg, ppm | 230 | 688 | 704 | 640 |
| Kappa number | 4.7 | 7.2 | 7.8 | 7.5 |
| Viscosity, dm3/kg | 890 | 910 | 917 | 901 |
| Brightness, % ISO | 74.5 | 72.2 | 71.1 | 71.5 |

| | Eo | EOP | EOP | EOP |
|---|---|---|---|---|
| t, min | 90 | 90 | 90 | 90 |
| T, C | 90 | 90 | 90 | 90 |
| Cs, % | 10 | 10 | 10 | 10 |
| pH | 10.5 | 10.5 | 10.5 | 10.5 |
| O2, bar | 8 | 8 | 8 | 8 |
| H2O2, kg/tp | - | 10 | 10 | 10 |
| Res. H2O2, kt/tp | - | 0.1 | 0.1 | 2.1 |
| Res. NaOH, kg/tp | 1.8 | 2.4 | 2.6 | 3.0 |
| Kappa number | 3.6 | 5.6 | 6.2 | 5.7 |
| Viscosity, dm3/kg | 871 | 806 | 846 | 850 |
| Brightness, % ISO | 77.4 | 82.7 | 82.9 | 85.5 |

| | D | D | D/PAA | D | D/PAA | Q/D/PAA | D | D/PAA | Q/D/PAA |
|---|---|---|---|---|---|---|---|---|---|
| t, min | 120 | 120 | 120 | 120 | 120 | 120 | 120 | 120 | 120 |
| T, C | 70 | 70 | 70 | 70 | 70 | 70 | 70 | 70 | 70 |
| Cs, % | 10 | 10 | 10 | 10 | 10 | 10 | 10 | 10 | 10 |
| pH | 4.5 | 4.5 | 5.5 | 4.5 | 5.5 | 5.5 | 4.5 | 5.5 | 5.5 |
| ClO2, kg/tp | 10 | 10 | 5 | 10 | 5 | 5 | 10 | 5 | 5 |
| PAA, kg/tp | - | - | 5 | - | 5 | 5 | - | 5 | 5 |
| Chelator | None | None | None | None | None | DTPA | None | None | BCEEA+ BCEEAA |
| Dose, kg/tg | - | - | - | - | - | 2 | - | - | 2 |
| Kappa number | 2.2 | 3.9 | 3.5 | 4.0 | 3.9 | 4.9 | 3.6 | 3.3 | 3.4 |
| Viscosity, dm3/kg | 860 | 792 | 767 | 827 | 798 | 799 | 855 | 834 | 856 |
| Brightness, % ISO | 86.2 | 86.6 | 88.0 | 86.5 | 87.5 | 87.2 | 87.7 | 88.8 | 89.1 |

EXAMPLE 2

An oxygen-delignified softwood sulfate pulp was delignified first with chlorine dioxide (2 D or Q/D in Table), this was followed by an oxygen-alkali stage reinforced with peroxide (EOP) and a final bleaching with chlorine dioxide and/or a combination of chlorine dioxide and peracetic acid (D or D/PAA). The reference was a D-Eo-D bleaching with an active chlorine dose of 46 kg/tp (total dose). The purpose of the experiment was merely to demonstrate the effect of the chelating agents in the chlorine dioxide stage, and therefore the pulps were not bleached to complete brightness. The results are shown in Table 2.

TABLE 2

ECF bleaching experiments on softwood sulfate pulp

| Initial situation | Oxygen-beignified birch pulp | | | |
|---|---|---|---|---|
| Kappa number | 11.5 | Fe | 14.3 | mg/kg |
| Viscosity, dm3/kg | 90.1 | Mn | 37.4 | mg/kg |
| Brightness, % ISO | 56.6 | | | |

| | D | D | Q/D | Q/D |
|---|---|---|---|---|
| t, min | 120 | 120 | 120 | 120 |
| T, C | 70 | 70 | 70 | 70 |
| Cs, % | 10 | 10 | 10 | 10 |
| Initial pH | 3.6 | 4 | 4 | 4.1 |
| Final pH | 2.7 | 3.6 | 3.4 | 3.4 |
| ClO2, kg/tp | 36 | 15 | 16 | 18 |
| Chelator | None | None | DTPA | BCEEA+ BCEEAA |
| Dose, kg/tp | - | - | 2 | 2 |
| Mn, ppm | 6.0 | 9.0 | 10.8 | 6.2 |
| Fe, ppm | 5.9 | 9.1 | 5.0 | 5.4 |
| Ca, ppm | 124 | 167 | 176 | 162 |
| Mg, ppm | 34 | 164 | 190 | 174 |
| Kappa number | 2.5 | 5.4 | 6.3 | 5.5 |
| Viscosity, dm3/kg | 815 | 815 | 841 | 851 |
| Brightness, % ISO | 62.4 | 53.3 | 54.5 | 55.8 |

| | Eo | EOP | EOP | EOP |
|---|---|---|---|---|
| t,min | 90 | 90 | 90 | 90 |
| T, C | 90 | 90 | 90 | 90 |
| Cs. % | 10 | 10 | 10 | 10 |
| pH | 10.5 | 10.5 | 10.5 | 10.5 |
| O2, bar | 8 | 8 | 8 | 8 |
| H2O2, kg/tp | - | 10 | 10 | 10 |
| NaO, kg/tp | 7 | 7 | 7 | 7 |
| Res. H2O2, kg/tp | - | 0.2 | 0.1 | 1.0 |
| Res. NaOH, kg/tp | 2.2 | 1.8 | 1.4 | 1.9 |
| Kappa number | 1.8 | 2.8 | 3.0 | 2.9 |
| Viscosity, dm3/kg | 802 | 760 | 781 | 780 |
| Brightness, % ISO | 68.8 | 72.2 | 71.2 | 75.2 |

| | D | D | D/PAA | D | D/PAA | Q/D/PAA | D | D/PAA | Q/D/PAA |
|---|---|---|---|---|---|---|---|---|---|
| t, min | 120 | 120 | 120 | 120 | 120 | 120 | 120 | 120 | 120 |
| T, C | 70 | 70 | 70 | 70 | 70 | 70 | 70 | 70 | 70 |
| Cs, % | 10 | 10 | 10 | 10 | 10 | 10 | 10 | 10 | 10 |
| pH | 4.5 | 4.5 | 5.5 | 4.5 | 5.5 | 5.5 | 4.5 | 5.5 | 5.5 |
| ClO2, kg/tp | 10 | 10 | 5 | 10 | 5 | 5 | 10 | 5 | 5 |
| PAA, kg/tp | - | - | 5 | - | 5 | 5 | - | 5 | 5 |
| Chelator | None | None | None | None | None | DTPA | None | None | BCEEA+ BCEEAA |
| Dose, kg/tg | - | - | - | - | - | 2 | - | - | 2 |
| Kappa number | 1 | 1.4 | 1.2 | 2.4 | 2.1 | 2.6 | 1.6 | 1.6 | 1.6 |
| Viscosity, dm3/kg | 802 | 756 | 732 | 759 | 768 | 748 | 757 | 759 | 784 |
| Brightness, % ISO | 84.3 | 81.9 | 84.1 | 76.3 | 80.8 | 80.2 | 81.6 | 84.9 | 86.7 |

Table 2 shows that the bleaching can be carried out using a D-EOP-D sequence with a total active chlorine dose of 28 kg/tp and an $H_2O_2$ dose of 10 kg/tp to the same degree of brightness as by using D-Eo-D with an active Cl dose of 46 kg/tp. However, the kappa number remains somewhat higher.

An examination of the heavy metal concentrations after the first chlorine dioxide stage (D or Q/D in the table) shows that a higher chlorine dioxide dose (36 kg of active Cl) also leads to low Fe and Mn concentrations owing to the low pH. At the same time the earth-alkali metal concentrations (Mg+Ca) also drop to very low levels. Earth alkali metals stabilize peroxide and hinder the breaking down of carbohydrates during bleaching. With a lower active chlorine dose in the $D_1$ stage the Fe and Mn concentrations are clearly higher, also the concentrations of Mg and Ca are clearly higher. When DTPA is used together with chlorine dioxide it is seen that the DTPA has no effect on the Mn concentration m the pulp. Instead, the BCEEA+BCEEAA chelating agent mixture clearly improves the removal of manganese and iron during the chlorine dioxide stage.

The table also shows that the concentrations of earth alkali metals are at least not lowered as compared with a normal D stage. The earth-alkali metal concentrations relatively low as compared with the initial levels are due to the low pH of the chlorine dioxide stage. The final pH was approx. 3.5 with an active chlorine dose of 18 kg/tp. A pH this low dissolves most of the calcium and magnesium regardless of whether a chelating agent is present.

The peroxide consumption of the EOP stage is lowest and the brightness highest when a BCEEA+BCEEAA mixture is used in the chlorine dioxide stage. This is due to the low Mn concentration in the pulp entering the EOP stage.

In the last bleaching stage with the D/PAA combination, DTPA is even detrimental, the degrees of brightness are clearly lower than in the other experiments. When DTPA is used at the end of the bleaching, the kappa number of the pulp is clearly highest. On the other hand, when a BCEEA+BCEEAA mixture is used in the D/PAA stage, the brightness clearly improves Table 2 shows also the favorable effect of the BCEEA+BCEEAA addition on the viscosity of the pulp. By using a BCEEA+BCEEAA mixture in the chlorine dioxide and/or D/PAA stage, a clear improvement is achieved as compared with unchelated or DTPA-chelated pulp.

What is claimed is:

1. A process for bleaching chemical pulp, wherein the pulp is subjected to a first treatment step including at least one of a delignification treatment and a bleaching treatment, said first treatment step comprising admixing said pulp with a treatment chemical selected from chlorine dioxide and an admixture of chlorine dioxide and a per-compound, and said process further including a second treatment step wherein the pulp is chelated by contact with a chelating chemical to bind heavy metals into a chelate complex, the process comprising:

subjecting said pulp to said first and said second treatment steps substantially simultaneously by combining, in a single stage, said pulp with said treatment chemical and said chelating chemical; and choosing said chelating chemical from a material selected from the group consisting of N-bis-[(1,2-dicarboxylethoxy)-ethyl]-amine; N-bis-[(1,2-dicarboxylethoxy)-ethyl]-aspartic acid, N-tris-[1,2-dicarboxylethoxy)-ethyl]-amine and alkali metal and earth-alkali metal salts of these materials.

2. The process of claim 1, further comprising subjecting said pulp to a third treatment step prior to said first and said second treatment steps, wherein said third treatment step comprises at least one of an oxygen delignification treatment, an ozone delignification treatment and an alkaline peroxide treatment.

3. The process of claim 1, further comprising subjecting said pulp to a fourth treatment step subsequent to said first and said second treatment steps, wherein said fourth treatment step comprises an alkaline peroxide treatment or an oxygen-alkali treatment reinforced with peroxide.

4. The process of claim 1, wherein said first treatment step is carried out using an admixture of chlorine dioxide and a per-acid.

5. The process of claim 4, wherein said first treatment step is carried out using an admixture of chlorine dioxide and peracetic acid.

6. The process of claim 1, wherein said first treatment step is carried out using an admixture of chlorine dioxide and peracetic acid.

7. The process of claim 1, wherein said pulp is subjected to a plurality of said first treatment steps.

8. The process of claim 1, wherein, when said treatment chemical is chlorine dioxide, the admixture in the first treatment step has a pH of 5 or less.

9. The process of claim 1, wherein, when said treatment chemical is said admixture of chlorine dioxide and a per-compound, the admixture has a pH of from 5 to 7.

10. The process of claim 1, wherein said pulp is a sulfate pulp.

11. The process of claim 10, wherein said sulfate pulp is obtained from hardwood or softwood.

* * * * *